US008798893B2

(12) United States Patent
Kachi et al.

(10) Patent No.: US 8,798,893 B2
(45) Date of Patent: Aug. 5, 2014

(54) FUEL INJECTION CONTROL APPARATUS FOR INTERNAL COMBUSTION ENGINE AND FUEL INJECTION CONTROL METHOD FOR INTERNAL COMBUSTION ENGINE

(75) Inventors: Masahiro Kachi, Susono (JP); Yasuyuki Takama, Gotemba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 299 days.

(21) Appl. No.: 13/368,647

(22) Filed: Feb. 8, 2012

(65) Prior Publication Data

US 2012/0203445 A1 Aug. 9, 2012

(30) Foreign Application Priority Data

Feb. 8, 2011 (JP) ..... 2011-025103

(51) Int. Cl.
*F02D 41/10* (2006.01)

(52) U.S. Cl.
USPC ..... 701/104; 123/676; 123/492; 123/682

(58) Field of Classification Search
CPC ..... F02D 41/1446; F02D 41/1447
USPC ..... 701/104; 123/492, 676, 682, 689
See application file for complete search history.

(56) References Cited

U.S. PATENT DOCUMENTS

| | | | | |
|---|---|---|---|---|
| 5,239,965 | A * | 8/1993 | Ninomiya | 123/492 |
| 6,578,557 | B1 * | 6/2003 | Messick | 123/491 |
| 7,228,221 | B2 * | 6/2007 | Niimi | 701/104 |
| 7,438,048 | B2 * | 10/2008 | Onobayashi et al. | 123/352 |
| 7,934,371 | B2 * | 5/2011 | Sugimoto | 60/285 |
| 8,447,500 | B2 * | 5/2013 | Suzuki et al. | 701/105 |
| 8,560,209 | B2 * | 10/2013 | Stefanon | 701/104 |
| 2011/0251779 | A1 | 10/2011 | Kachi et al. | |

FOREIGN PATENT DOCUMENTS

| | | | |
|---|---|---|---|
| JP | 2003343242 | A | 12/2003 |
| JP | 2011-220214 | A | 11/2011 |

* cited by examiner

*Primary Examiner* — Erick Solis
(74) *Attorney, Agent, or Firm* — Gifford, Krass, Sprinkle, Anderson & Citkowski, P.C.

(57) ABSTRACT

A fuel injection control for an internal combustion engine includes: estimating a convergence temperature of the exhaust gas catalytic converter; calculating an OTP boost value using the estimated convergence temperature; and estimating the convergence temperature on the assumption that the temperature decrement quantity of the exhaust gas catalytic converter which is caused by the power boosting is zero when both of the OTP boosting execution condition and the power boosting execution condition are met.

5 Claims, 10 Drawing Sheets

FUEL INJECTION CONTROL APPARATUS FOR INTERNAL COMBUSTION ENGINE AND FUEL INJECTION CONTROL METHOD FOR INTERNAL COMBUSTION ENGINE

CROSS REFERENCE TO RELATED APPLICATIONS

This application claims priority to Japanese Patent Application No. 2011-025103 filed on Feb. 8, 2011, which is incorporated herein by reference in its entirety including the specification, drawings and abstract.

BACKGROUND OF THE INVENTION

1. Field of the Invention

The present invention relates to a fuel injection control apparatus for an internal combustion engine and a fuel injection control method for the internal combustion engine.

2. Description of Related Art

For fuel injection amount control for the internal combustion engine, a boost correction such as so-called over-temperature protection (OTP) boosting or power boosting is known to increase and correct the fuel injection amount more than a normal operating condition of the engine. The OTP boosting is a boost correction of the fuel injection amount that is performed to prevent overheating of an exhaust gas catalytic converter. When the fuel injection amount is boosted, exhaust gas temperature decreases by vaporization heat of fuel, and therefore the temperature of the exhaust gas catalytic converter can be decreased. On the other hand, the power boosting is a boost correction of the fuel injection amount that is performed to increase output torque. When air-fuel ratio of mixture is decreased to output air-fuel ratio through boosting of the fuel injection amount, the output torque can be increased.

The boost corrections described above are performed when the operating condition of the internal combustion engine is in a specific operating condition. For example, the OTP boosting may be performed in a high load and high speed operating condition, and the power boosting may be performed in a high load operating condition in which sudden acceleration is required. Here, a boost value of the fuel injection amount in the OTP boosting is referred to as an OTP boost value, and a boost value of the fuel injection amount in the power boosting is referred to as a power boost value.

Japanese Patent Application Publication No. 2003-343242 discloses a technique that obtains a basic value of estimated steady temperature of a catalyst in a steady operating condition of an internal combustion engine on the basis of engine speed and engine load and corrects the basic value in accordance with at least one of retarding degree of ignition timing, reflowing degree of exhaust gas into intake system, boosting degree of fuel injection amount in approximately full open of a throttle valve to obtain the estimated steady temperature of the catalyst.

When the OTP boost value in OTP boosting is excessively large with respect to the temperature of the exhaust gas catalytic converter, it may result in worsening of fuel economy or exhaust characteristic. Thus, when the OTP boosting is performed, the temperature of the exhaust gas catalytic converter is estimated, and the OTP boost value needs to be adjusted to the value in accordance with the estimated temperature.

Even in the case where the power boosting is performed, as in the case where the OTP boosting is performed, the temperature of exhaust gas decreases by the vaporization heat of fuel, and therefore the temperature of the exhaust gas catalytic converter decreases along with it. Thus, when the temperature of the exhaust gas catalytic converter is estimated during the power boosting, temperature decreasing amount for the exhaust gas catalytic converter caused by the power boosting usually needs to be considered.

SUMMARY OF THE INVENTION

The present invention provides a fuel injection control apparatus for the internal combustion engine and a fuel injection control method for the internal combustion engine that prevent worsening of fuel economy or exhaust characteristic when the OTP boosting is performed by adjusting the OTP boost value to a more appropriate value.

In a first aspect of the present invention, the fuel injection control apparatus for an internal combustion engine estimates the convergence temperature of the exhaust gas catalytic converter, calculates the OTP boost value by using the estimated convergence temperature, and estimates the convergence temperature of the exhaust gas catalytic converter on the assumption that the temperature decrement quantity of the exhaust gas catalytic converter which is caused by the power boosting is zero, when both of the OTP boosting execution condition and the power boosting execution condition are met.

More specifically, a fuel injection control apparatus for an internal combustion engine according to a first aspect of the present invention includes: a fuel injection amount control section that increases a fuel injection amount by a larger one of an OTP boost value of an OTP boosting and a power boost value of a power boosting when both of an OTP boosting execution condition and a power boosting execution condition are met, in which the OTP boosting execution condition is an execution condition for the OTP boosting that increases the fuel injection amount in order to prevent overheating of an exhaust gas catalytic converter, and the power boosting execution condition is an execution condition for the power boosting that increases the fuel injection amount in order to set air-fuel ratio of mixture to output air-fuel ratio; a convergence temperature estimation section that estimates a convergence temperature of the exhaust gas catalytic converter on the assumption that an operating condition of the internal combustion engine is in a normal operating condition by correcting a reference convergence temperature, which is calculated in accordance with engine speed and engine load, based on a temperature decrement quantity of the exhaust gas catalytic converter which is caused by at least the power boosting; an ordinary temperature estimation section that estimates an ordinary temperature that is a current temperature of the exhaust gas catalytic converter on the assumption that an operating condition of the internal combustion engine is in a normal operating condition, in accordance with the convergence temperature; an OTP boost correction value calculation section that calculates an OTP boost correction value, which is the OTP boost value on the assumption that temperature of the exhaust gas catalytic converter is the ordinary temperature, by correcting an OTP boost reference value, which is the OTP boost value on the assumption that the temperature of the exhaust gas catalytic converter is the convergence temperature, in accordance with the ordinary temperature and the convergence temperature; and an OTP boost value determination section that selects either of the OTP boost reference value or the OTP boost correction value as the OTP boost value when the OTP boosting is performed, and in the fuel injection control apparatus, when both of the OTP boosting execution condition and the power boosting execution condition are met, the convergence temperature estimation section estimates the convergence temperature on the assumption that the temperature decrement quantity of the exhaust gas catalytic converter which is caused by the power boosting is zero.

A fuel injection control method for an internal combustion engine according to a second aspect of the present invention includes: increasing a fuel injection amount by a larger one of an OTP boost value of an OTP boosting and a power boost value of a power boosting when both of an OTP boosting execution condition and a power boosting execution condition are met, in which the OTP boosting execution condition is an execution condition for the OTP boosting that increases the fuel injection amount in order to prevent overheating of an exhaust gas catalytic converter, and the power boosting execution condition is an execution condition for the power boosting that increases the fuel injection amount in order to set air-fuel ratio of mixture to output air-fuel ratio; estimating a convergence temperature of the exhaust gas catalytic converter on the assumption that an operating condition of the internal combustion engine is in a normal operating condition by correcting a reference convergence temperature, which is calculated in accordance with engine speed and engine load, based on a temperature decrement quantity of the exhaust gas catalytic converter which is caused by at least the power boosting; estimating an ordinary temperature that is a current temperature of the exhaust gas catalytic converter on the assumption that an operating condition of the internal combustion engine is in a normal operating condition, in accordance with the convergence temperature; calculating an OTP boost correction value, which is the OTP boost value on the assumption that temperature of the exhaust gas catalytic converter is the ordinary temperature, by correcting an OTP boost reference value, which is the OTP boost value on the assumption that the temperature of the exhaust gas catalytic converter is the convergence temperature, in accordance with the ordinary temperature and the convergence temperature; and selecting either of the OTP boost reference value or the OTP boost correction value as the OTP boost value when the OTP boosting is performed, and in the fuel injection control method, when both of the OTP boosting execution condition and the power boosting execution condition are met, the convergence temperature is estimated on the assumption that the temperature decrement quantity of the exhaust gas catalytic converter which is caused by the power boosting is zero.

When the operating condition of the internal combustion engine is continued for a period under a certain normal operating condition (that is, the operating condition where the OTP boosting and the power boosting are not performed), the temperature of the exhaust gas catalytic converter converges to the temperature corresponding to the operating condition. The temperature at that time is referred to as a convergence temperature. In addition, the current temperature of the exhaust gas catalytic converter on the assumption that the operating condition of the internal combustion engine is in the normal operating condition is referred to as an ordinary temperature.

In the first and the second aspects of the present invention, the OTP boosting is performed when the OTP boosting execution condition is met, and the power boosting is performed when the power boosting execution condition is met. When both of the OTP boosting execution condition and the power boosting execution condition are met, a boost correction in accordance with a larger boost value of an OTP boosting and a power boosting is performed.

As the OTP boost value in the OTP boosting, either of the OTP boost reference value or the OTP boost correction value is set. The convergence temperature and the ordinary temperature of the exhaust gas catalytic converter are used to the calculation of the OTP boost correction value.

When both of the OTP boosting execution condition and the power boosting execution condition are met, and when the OTP boost value is greater than the power boost value, the OTP boosting is selected and performed. At this time, because the power boosting execution condition is met, as in the case where the power boosting is performed, when the convergence temperature is estimated by correcting the reference convergence temperature based on the temperature decrement quantity of the exhaust gas catalytic converter which is caused by the power boosting, the estimated value is calculated as the lower value than the actual convergence temperature. As a result, the OTP boost correction value that is calculated by using the estimated value of the convergence temperature may become unnecessarily large. In this case, if the OTP boost correction value is selected as the OTP boost value and the OTP boosting is performed, the large boost value becomes excessive, and it may result in worsening of fuel economy or exhaust characteristic.

Therefore, in the first and the second aspect of the present invention, when both of the OTP boosting execution condition and the power boosting execution condition are met, the convergence temperature estimation section estimates the convergence temperature on the assumption that the temperature decrement quantity of the exhaust gas catalytic converter which is caused by the power boosting is zero. Accordingly, the convergence temperature is prevented from being calculated as the lower value than the actual convergence temperature. As a result, the OTP boost correction value is prevented from becoming unnecessarily large. Therefore, worsening of fuel economy or exhaust characteristic can be prevented when the OTP boosting is performed.

The fuel injection control apparatus according to the aforementioned aspect of the present invention may further include a temperature decrement quantity calculation section that calculates the temperature decrement quantity of the exhaust gas catalytic converter which is caused by the increase in the fuel injection amount equivalent to difference between the power boost value and the OTP boost value when both of the OTP boosting execution condition and the power boosting execution condition are met and when the power boost value is greater than the OTP boost value. When both of the OTP boosting execution condition and the power boosting execution condition are met and when the power boost value is greater than the OTP boost value, the convergence temperature estimation section may estimate the convergence temperature by correcting the reference convergence temperature based on the temperature decrement quantity that is calculated by the temperature decrement quantity calculation section in place of the temperature decrement quantity of the exhaust gas catalytic converter which is caused by the power boosting.

Accordingly, the convergence temperature, which is calculated during the power boosting, becomes the value that reflects the temperature decrement quantity which is caused by the increase in the fuel injection amount equivalent to the difference between the power boost value and the OTP boost value. The ordinary temperature is estimated in accordance with the convergence temperature that is calculated as described above. Therefore, the OTP boost correction value that is calculated by using the convergence temperature and the ordinary temperature can be determined to be more appropriate value. As a result, when the OTP boosting is performed by using the OTP boost correction value as the OTP boost value for the next time, more appropriate boost correction of the fuel injection amount can be performed.

According to the first and the second aspect of the present invention; the OTP boost value can be adjusted to a more appropriate value. As a result, worsening of fuel economy or exhaust characteristic can be prevented when the OTP boosting is performed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Specific embodiments according to the present invention will be described hereinafter with reference to the attached drawings. Dimensions, materials, shapes, and relative arrangement of components described in this embodiment are not intended to limit technical scope of the present invention therein unless otherwise specified.

Embodiment 1

[Schematic Structure of Intake and Exhaust Systems for Internal Combustion Engine]

Figure 1:
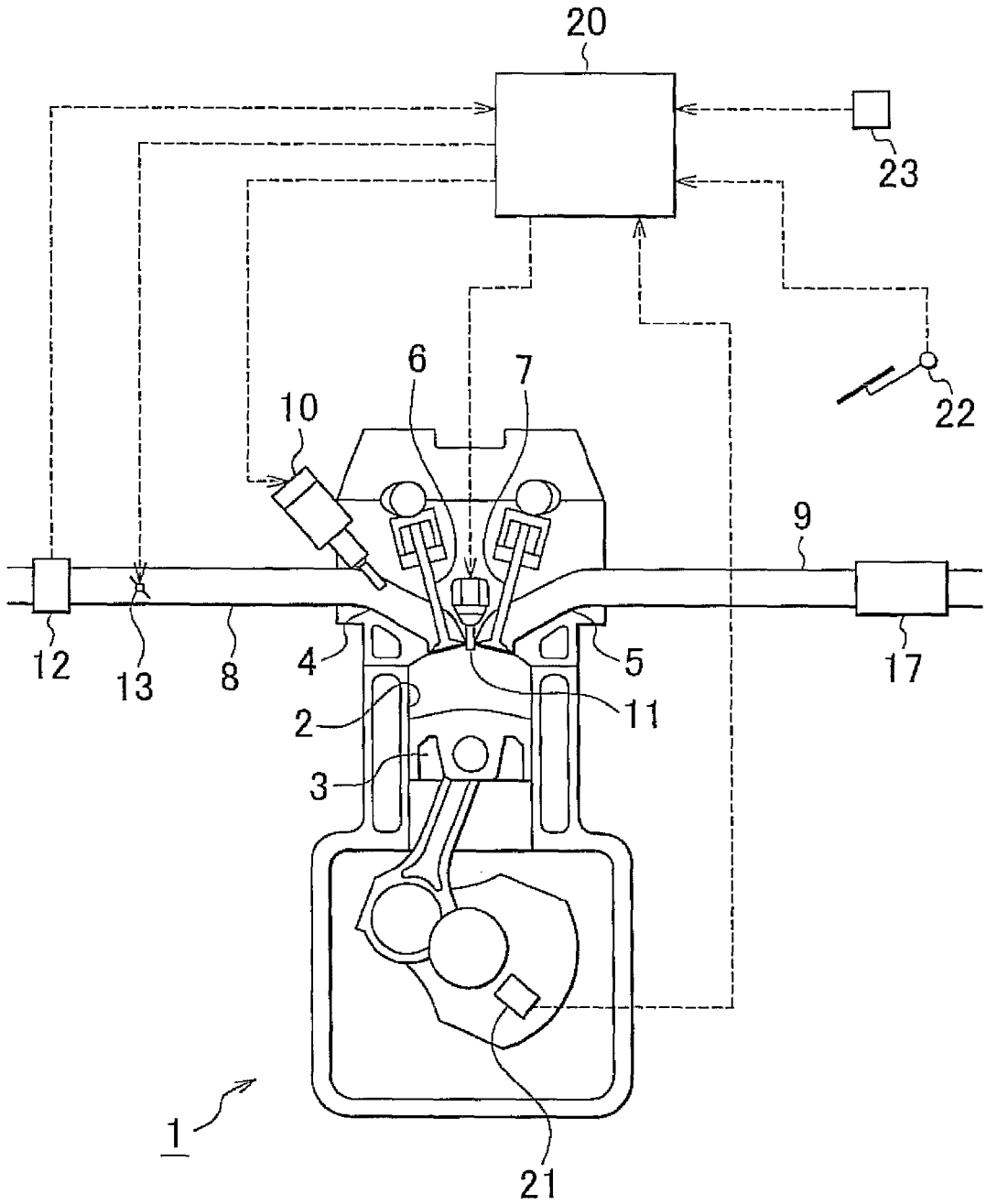
FIG. 1 is a schematic view that shows the structure of an intake and an exhaust system for the internal combustion engine according to Embodiment 1.

FIG. 1 is a schematic view that shows the structure of an intake and an exhaust system for the internal combustion engine according to this embodiment. The internal combustion engine 1 is a gasoline engine for driving a vehicle which has four cylinders 2. However, the internal combustion engine according to the present invention is not limited to the gasoline engine, but may be a diesel engine, for example.

A piston 3 is slidably disposed within a cylinder 2. An intake port 4 and an exhaust port 5 are connected to a combustion chamber in an upper section in the cylinder 2. Openings of the intake port 4 and the exhaust port 5 to the combustion chamber are opened or closed by an intake valve 6 and an exhaust valve 7, respectively.

A fuel injection valve 10 and a spark plug 11 are installed in the internal combustion engine 1. The fuel injection valve 10 sprays fuel into the intake port 4. The spark plug 11 ignites the air-fuel mixture in the combustion chamber within the cylinder 2.

An intake passage 8 is connected to the intake port 4. An exhaust passage 9 is connected to the exhaust port 5. The intake passage 8 includes an air flow meter 12 and a throttle valve 13 that are disposed in that order along the flow of intake air from an upstream side. An exhaust gas catalytic converter 17 is disposed in the exhaust passage 9. The exhaust gas catalytic converter 17 has a structure that includes a three-way catalyst. However, the exhaust gas catalytic converter according to the present invention is not limited to the structure that includes the three-way catalyst. The exhaust gas catalytic converter may have a structure that includes well-known catalysts such as an oxidation catalyst and an absorption and reduction type NOx catalyst, for example.

The internal combustion engine 1 that is constructed as described above also has an electronic control unit (ECU) 20. The ECU 20 is electrically connected to the air flow meter 12 as well as a crankshaft position sensor 21, an accelerator pedal operation amount sensor 22, and a vehicle speed sensor 23. Output signals from these sensors are input to the ECU 20.

The crankshaft position sensor 21 is a sensor that monitors (or detects) a crank angle of the internal combustion engine 1. The accelerator pedal operation amount sensor 22 is a sensor that monitors an accelerator pedal operation amount of the vehicle which is equipped with the internal combustion engine 1. The vehicle speed sensor 23 is a sensor that monitors speed of the vehicle which is equipped with the internal combustion engine 1. The ECU 20 calculates engine speed of the internal combustion engine 1 based on a monitored value of the crankshaft position sensor 21. The ECU 20 also calculates engine load of the internal combustion engine 1 based on a monitored value of the accelerator pedal operation amount sensor 22.

In addition, the ECU 20 is electrically connected to the fuel injection valve 10, the spark plug 11 and the throttle valve 13. The ECU 20 controls these devices.

[Fuel Injection Amount Control]

In the internal combustion engine 1, when the operating condition is normal, the control of the fuel injection amount is performed such that target air-fuel ratio of the air-fuel mixture is a stoichiometric air-fuel ratio. However, the target air-fuel ratio in the normal operating condition of the internal combustion engine according to the present invention is not limited to the stoichiometric air-fuel ratio. When the operating condition of the internal combustion engine 1 is in a specific operating condition, the OTP boosting or the power boosting that increases and corrects the fuel injection amount more than the normal operating condition is performed. The OTP boosting is performed in a first specified operating condition where the operating condition of the internal combustion engine 1 is in a high load and high speed operating condition. The power boosting is performed in a second specified operating condition where the operating condition of the internal combustion engine 1 is in a high load operating condition. The first and the second specified operating conditions are determined in advance based on experiment and the like.

Figure 2:
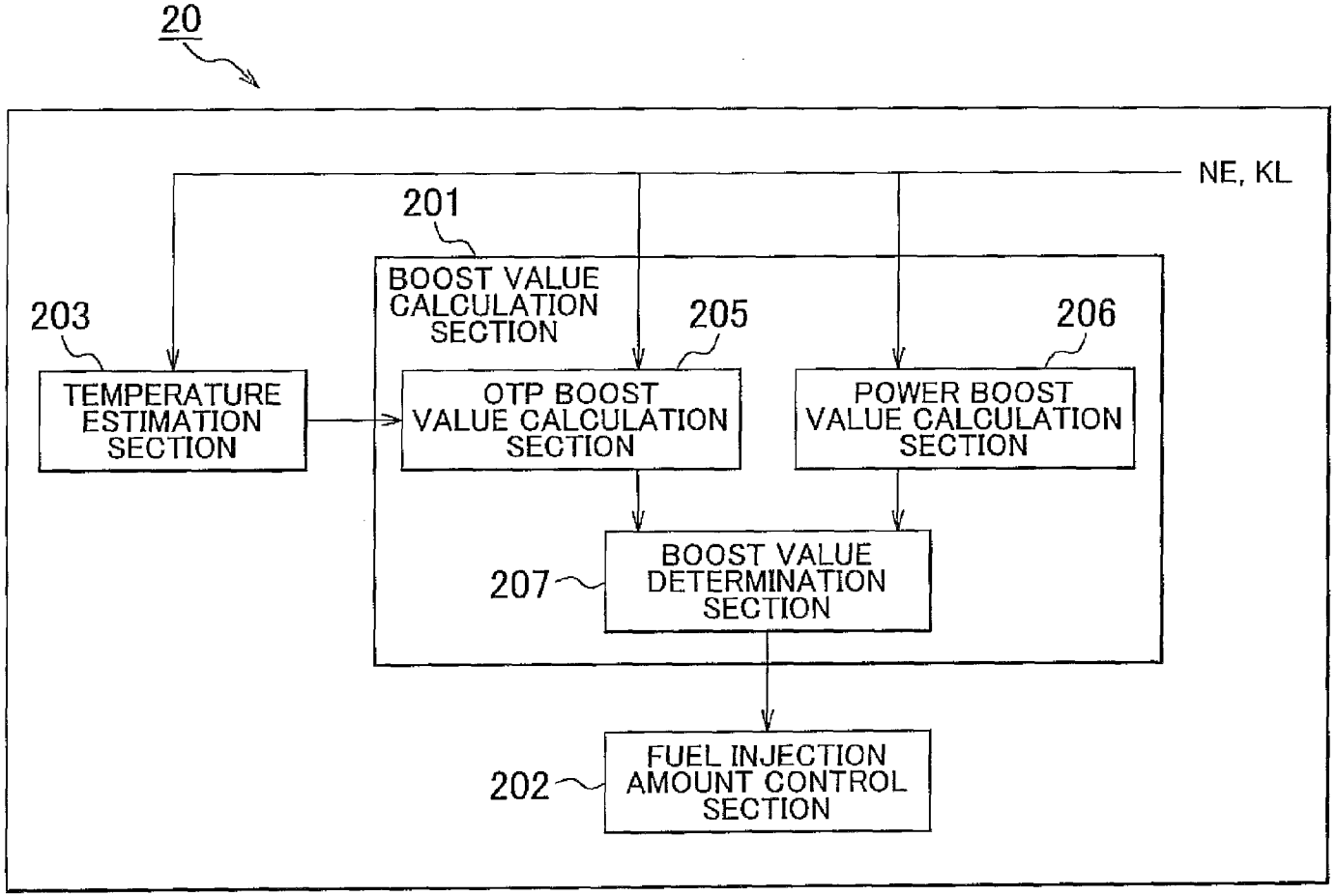
FIG. 2 is a block diagram that shows an outline of functional components of a part relating to the fuel injection control in an ECU according to Embodiment 1.
Figure 3:
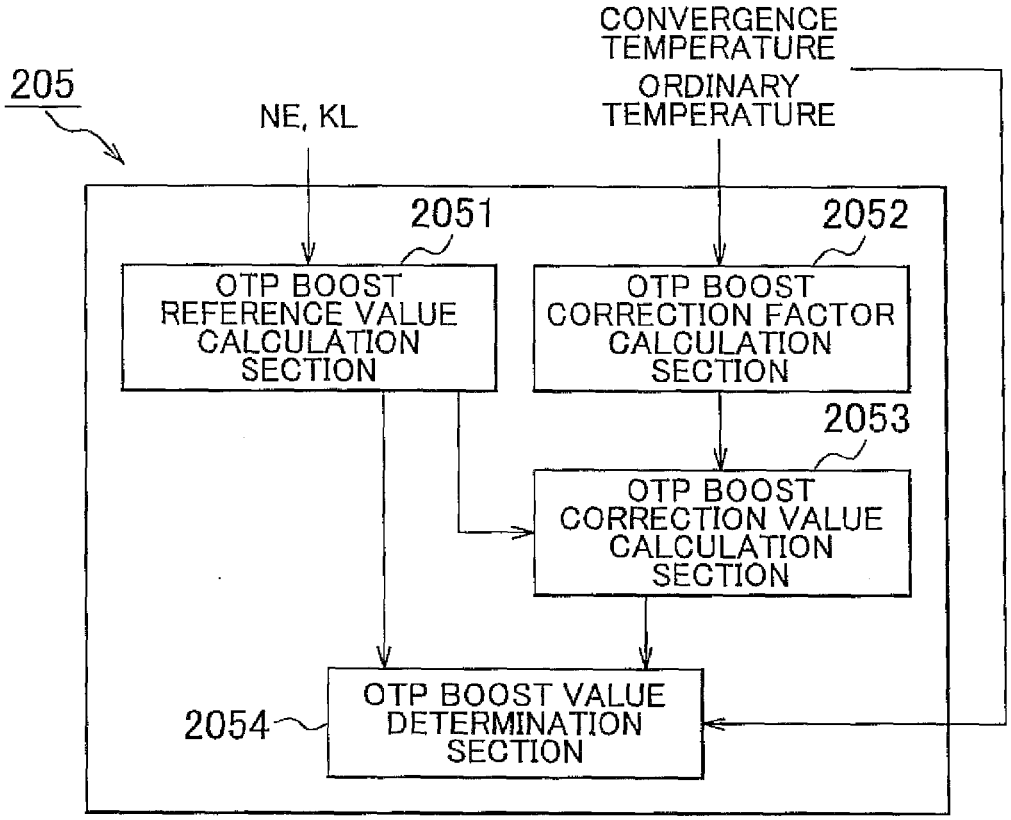
FIG. 3 is a block diagram that shows an outline of functional components of an OTP boost value calculation section according to Embodiment 1.
Figure 4:
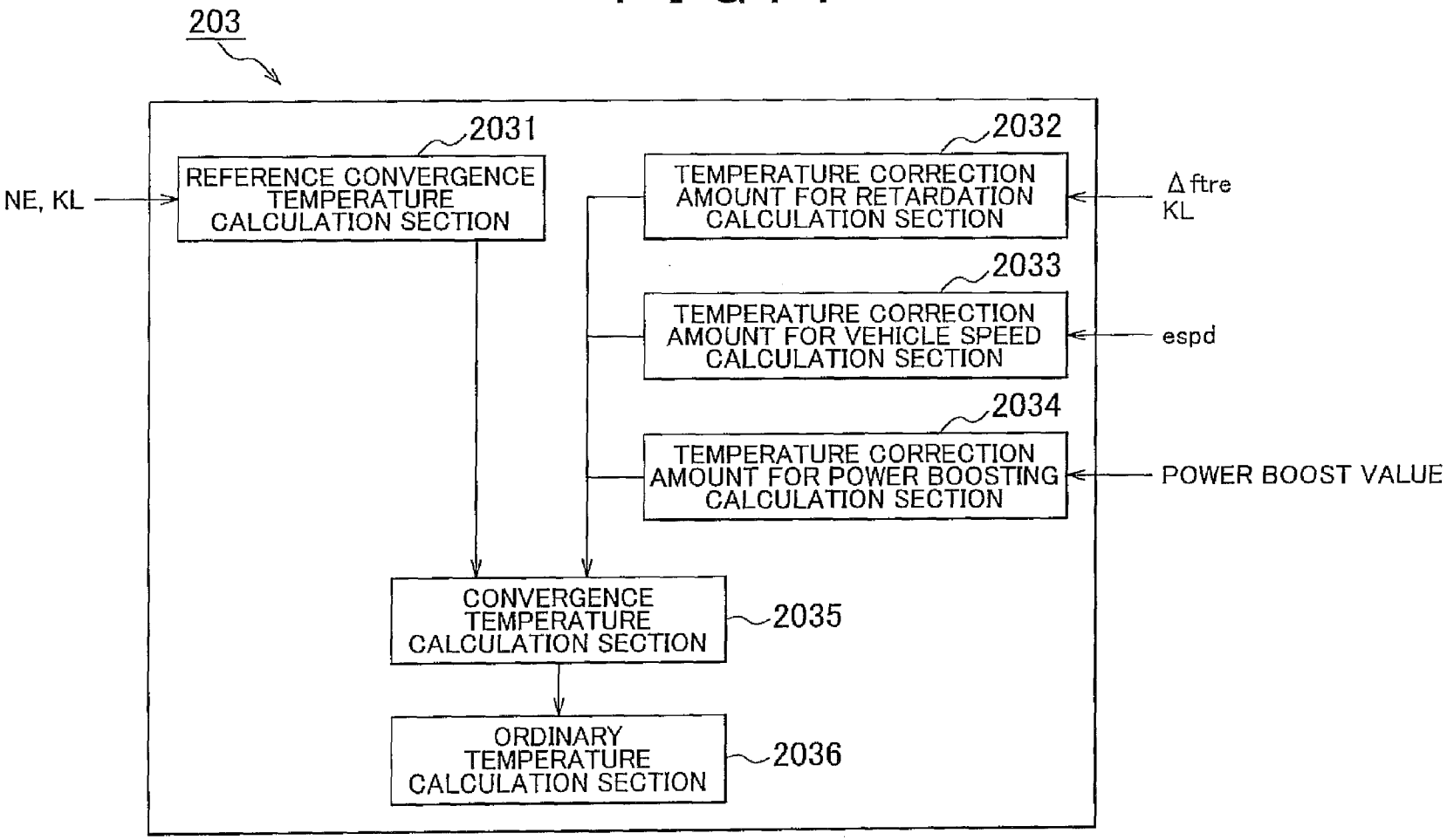
FIG. 4 is a block diagram that shows an outline of functional components of a temperature estimation section according to Embodiment 1.

FIGS. 2 through 4 are block diagrams that show outlines of functional components of parts relating to the fuel injection control in the ECU 20. As shown in FIG. 2, the ECU 20 includes a boost value calculation section 201, a fuel injection amount control section 202, and a temperature estimation section 203.

The boost value calculation section 201 determines a boost value in the boost correction of the fuel injection amount. The fuel injection amount control section 202 controls the fuel injection amount from the fuel injection valve 10. The temperature estimation section 203 estimates the convergence temperature and the ordinary temperature of the exhaust gas catalytic converter 17. The convergence temperature is the convergence temperature of the exhaust gas catalytic converter 17 on the assumption that the operating condition of the internal combustion engine 1 is in the normal operating condition, that is to say, the air-fuel ratio of the mixture in the internal combustion engine 1 is the stoichiometric air-fuel ratio. Furthermore, the ordinary temperature is a current temperature of the exhaust gas catalytic converter 17 on the assumption that the operating condition of the internal combustion engine 1 is in the normal operating condition, that is to say, the air-fuel ratio of the mixture in the internal combustion engine 1 is the stoichiometric air-fuel ratio. The details of the temperature estimation section 203 will be described later.

The boost value calculation section 201 includes an OTP boost value calculation section 205, a power boost value calculation section 206, and a boost value determination section 207. The OTP boost value calculation section 205 calculates the OTP boost value that is a correction term of the fuel injection amount in the OTP boosting. The OTP boost value calculation section 205 calculates the value greater than 1 as the OTP boost value when the operating condition of the internal combustion engine 1 is in the first specified operating condition. The details of the OTP boost value calculation section 205 will be described later.

The power boost value calculation section 206 calculates the power boost value that is a correction term of the fuel injection amount in the power boosting in accordance with engine speed NE and engine load KL. The ECU 20 stores in advance a map or a function that shows a relation among the power boost value, the engine speed NE, and the engine load KL. The power boost value calculation section 206 calculates the power boost value by using the map or the function. The power boost value calculation section 206 calculates the value greater than 1 as the power boost value when the operating condition of the internal combustion engine 1 is in the second specified operating condition.

The boost value determination section 207 determines the boost value in accordance with the OTP boost value that is calculated with the OTP boost value calculation section 205 and the power boost value that is calculated with the power boost value calculation section 206. That is, when the OTP boost value is greater than 1, the OTP boost value is determined to be the boost value, and when the power boost value is greater than 1, the power boost value is determined to be the boost value. In addition, when both the OTP boost value and the power boost value are greater than 1, the boost value determination section 207 selects the greater value of the OTP boost value and the power boost value to determine the boost value.

The fuel injection amount control section 202 performs the boost correction of the fuel injection amount by correcting a reference fuel injection amount that is determined in accordance with the operating condition of the internal combustion engine 1 (a fuel injection amount when the operating condition of the internal combustion engine 1 is in the normal operating condition) based on the boost value that is calculated by the boost value calculation section 201.

FIG. 3 is a block diagram that shows an outline of functional components of the OTP boost value calculation section 205. The OTP boost value calculation section 205 includes an OTP boost reference value calculation section 2051, an OTP boost correction factor calculation section 2052, an OTP boost correction value calculation section 2053, and an OTP boost value determination section 2054.

The OTP boost reference value calculation section 2051 calculates an OTP boost reference value in accordance with the engine speed NE and the engine load KL of the internal combustion engine 1. The OTP boost reference value is the OTP boost value on the assumption that the temperature of the exhaust gas catalytic converter 17 is the convergence temperature. In other words, the OTP boost reference value is the boost value so that the temperature of the exhaust gas catalytic converter 17 is decreased from the convergence temperature to the temperature lower than an OT determination temperature. Here, the OT determination temperature is a threshold temperature in which the exhaust gas catalytic converter 17 is determined to be overheated if the temperature of the exhaust gas catalytic converter 17 is greater than or equal to the OT determination temperature. The ECU 20 stores in advance a map or a function that shows a relation among the engine speed NE and the engine load KL of the internal combustion engine 1 and the OTP boost reference value. The OTP boost reference value calculation section 2051 calculates the OTP boost reference value by using the map or the function.

The OTP boost correction factor calculation section 2052 calculates an OTP boost correction factor that is a correction factor for correcting the OTP boost reference value. The OTP boost correction factor Cot is calculated by using the following equation (1) in accordance with the convergence temperature Tco and the ordinary temperature Tno that are calculated in the temperature estimation section 203 and the OT determination temperature T0.

$$Cot=(Tno-T0)/(Tco-T0) \quad (1)$$

The OTP boost correction value calculation section 2053 calculates an OTP boost correction value. The OTP boost correction value is the OTP boost value on the assumption that the temperature of the exhaust gas catalytic converter 17 is the ordinary temperature. In other words, the OTP boost correction value is the boost value so that the temperature of the exhaust gas catalytic converter 17 is decreased from the ordinary temperature to the temperature lower than the OT determination temperature. The OTP boost correction value ekotpc is calculated by using the following equation (2) in accordance with the OTP boost reference value ekotpb and the OTP boost correction factor Cot.

$$ekotpc=Cot\times ekotpb \quad (2)$$

The OTP boost value determination section 2054 compares the convergence temperature with the ordinary temperature as well as the OTP boost reference value with the OTP boost correction value, and therefore selects either of the OTP boost reference value or the OTP boost correction value as the OTP boost value. That is, when the convergence temperature is lower than the ordinary temperature, or when the OTP boost reference value is smaller than the OTP boost correction value, the OTP boost value determination section 2054 determines to set the OTP boost reference value as the OTP boost value. On the other hand, in the case that the ordinary temperature is lower than or equal to the convergence temperature and that the OTP boost correction value is smaller than or equal to the OTP boost reference value, the OTP boost value determination section 2054 determines to set the OTP boost correction value as the OTP boost value.

When the ordinary temperature of the exhaust gas catalytic converter 17 is lower than the convergence temperature, if the OTP boosting is performed as the OTP boost reference value being the boost value, the fuel injection amount excessively increases. In the case that the OTP boost value is determined as described above, excessive increase in the fuel injection amount can be prevented during such the OTP boosting.

FIG. 4 is a block diagram that shows an outline of functional components of the temperature estimation section 203. The temperature estimation section 203 estimates the convergence temperature and the ordinary temperature of the exhaust gas catalytic converter 17 which are used to determine whether the OTP boosting is performed and to calculate the OTP boost value during the OTP boosting. The temperature estimation section 203 includes a reference convergence temperature calculation section 2031, a temperature correction amount for retardation calculation section 2032, a temperature correction amount for vehicle speed calculation section 2033, a temperature correction amount for power boosting calculation section 2034, a convergence temperature calculation section 2035, and an ordinary temperature calculation section 2036.

The reference convergence temperature calculation section 2031 calculates a reference convergence temperature in accordance with the engine speed NE and the engine load KL of the internal combustion engine 1. The ECU 20 stores in advance a map or a function that shows a relation among the engine speed NE and the engine load KL of the internal combustion engine 1 and the reference convergence temperature. The reference convergence temperature calculation section 2031 calculates the reference convergence temperature by using the map or the function.

The convergence temperature is calculated by the correction of the reference convergence temperature in accordance with a plurality of correction items that have influence on the temperature of the exhaust gas catalytic converter 17. The temperature correction amount for retardation calculation section 2032 calculates a temperature correction amount for retardation in accordance with a retardation amount Δtfre of fuel injection timing and the engine load KL of the internal combustion engine 1. The temperature correction amount for retardation is a temperature increment quantity of the exhaust gas catalytic converter 17 which is caused by the retardation of the fuel injection timing. The ECU 20 stores in advance a map or a function that shows a relation among the retardation amount Δtfre of the fuel injection timing, the engine load KL of the internal combustion engine 1, and the temperature correction amount for retardation. The temperature correction amount for retardation calculation section 2032 calculates the temperature correction amount for retardation by using the map or the function.

The temperature correction amount for vehicle speed calculation section 2033 calculates a temperature correction amount for vehicle speed in accordance with vehicle speed espd of the vehicle in which the internal combustion engine 1 is mounted. The temperature correction amount for vehicle speed is a temperature decrement quantity of the exhaust gas catalytic converter 17 which is caused by removing of heat due to traveling wind of the vehicle. The ECU 20 stores in advance a map or a function that shows a relation between the vehicle speed espd and the temperature correction amount for vehicle speed. The temperature correction amount for vehicle speed calculation section 2033 calculates the temperature correction amount for vehicle speed by using the map or the function.

The temperature correction amount for power boosting calculation section 2034 calculates a temperature correction amount for power boosting in accordance with the power boost value that is calculated with the power boost value calculation section 206. Even in the case where the power boosting is performed, as in the case where the OTP boosting is performed, the temperature of exhaust gas decreases by the vaporization heat of fuel, and therefore the temperature of the exhaust gas catalytic converter 17 decreases along with it. The temperature correction amount for power boosting is a temperature decrement quantity of the exhaust gas catalytic converter 17 which is caused by the power boosting. The ECU 20 stores in advance a map or a function that shows a relation between the power boost value and the temperature correction amount for power boosting. The temperature correction amount for power boosting calculation section 2034 calculates the temperature correction amount for power boosting by using the map or the function.

The convergence temperature calculation section 2035 calculates the convergence temperature of the exhaust gas catalytic converter 17. The convergence temperature Tco is calculated by using the following equation (3) in accordance with the reference convergence temperature Tcob, the temperature correction amount for retardation ΔTr, the temperature correction amount for vehicle speed ΔTs, and the temperature correction amount for power boosting ΔTp.

$$Tco = Tcob - \Delta Tp + \Delta Tr - \Delta Ts \quad (3)$$

Here, in this embodiment as described above, the convergence temperature is calculated by correcting the reference convergence temperature in accordance with the temperature correction amount for retardation, the temperature correction amount for vehicle speed, and the temperature correction amount for power boosting; however, the correction items are not limited to the above as long as at least the temperature correction amount for power boosting is included.

The ordinary temperature calculation section 2036 calculates the ordinary temperature of the exhaust gas catalytic converter 17. The ordinary temperature Trio is calculated by using the following equation (4) to perform smoothing of the convergence temperature Tco.

$$Tno(n) = Tno(n-1) + (Tco - Tno(n-1))/k \quad (4)$$

In the above equation (4), Tno(n) denotes the ordinary temperature that is calculated this time, and Tno(n−1) denotes the ordinary temperature that is previously calculated. In addition, k denotes the number of times in which the smoothing is performed.

Here, the calculation method of the convergence temperature when the operating condition of the internal combustion engine 1 is in the first specified operating condition as well as in the second specified operating condition will be described. As described above, when both the OTP boost value and the power boost value are greater than 1 (that is, the operating condition of the internal combustion engine 1 is in the first specified operating condition as well as in the second specified operating condition), the greater value of the OTP boost value and the power boost value is determined to be the boost value, and the boost correction of the fuel injection amount is performed. At this time, because the OTP boost value is greater than the power boost value, even though the power boosting is not performed when the OTP boosting is selected and performed, if the temperature correction amount for power boosting ΔTp that is calculated in accordance with the power boost value affects the calculation of the convergence temperature Tco by using the above equation (3), then the convergence temperature Tco is calculated as a lower value than the actual value.

Thus, the value of the OTP boost correction factor Cot that is calculated by using the convergence temperature Tco into the above equation (1) becomes large. As a result, the OTP boost correction value ekotpc that is calculated by using the above equation (2) becomes unnecessarily large. If such the unnecessarily large OTP boost correction value is selected as the OTP boost value in the next time and the OTP boosting is performed, the large boost value becomes excess, and it may result in worsening of fuel economy or exhaust characteristic.

Therefore, in this embodiment, when both the OTP boost value and the power boost value are greater than 1, the convergence temperature calculation section 2035 calculates the convergence temperature Tea on the assumption that the temperature correction amount for power boosting ΔTp is zero. Accordingly, the convergence temperature is prevented from being calculated as the lower value than the actual value. As a result, the OTP boost correction value ekotpc is prevented from becoming unnecessarily large. Therefore, when the OTP boost correction value ekotpc is selected as the OTP boost value at the next time and the OTP boosting is performed, resulting in worsening of fuel economy or exhaust characteristic can be prevented.

Figure 5:
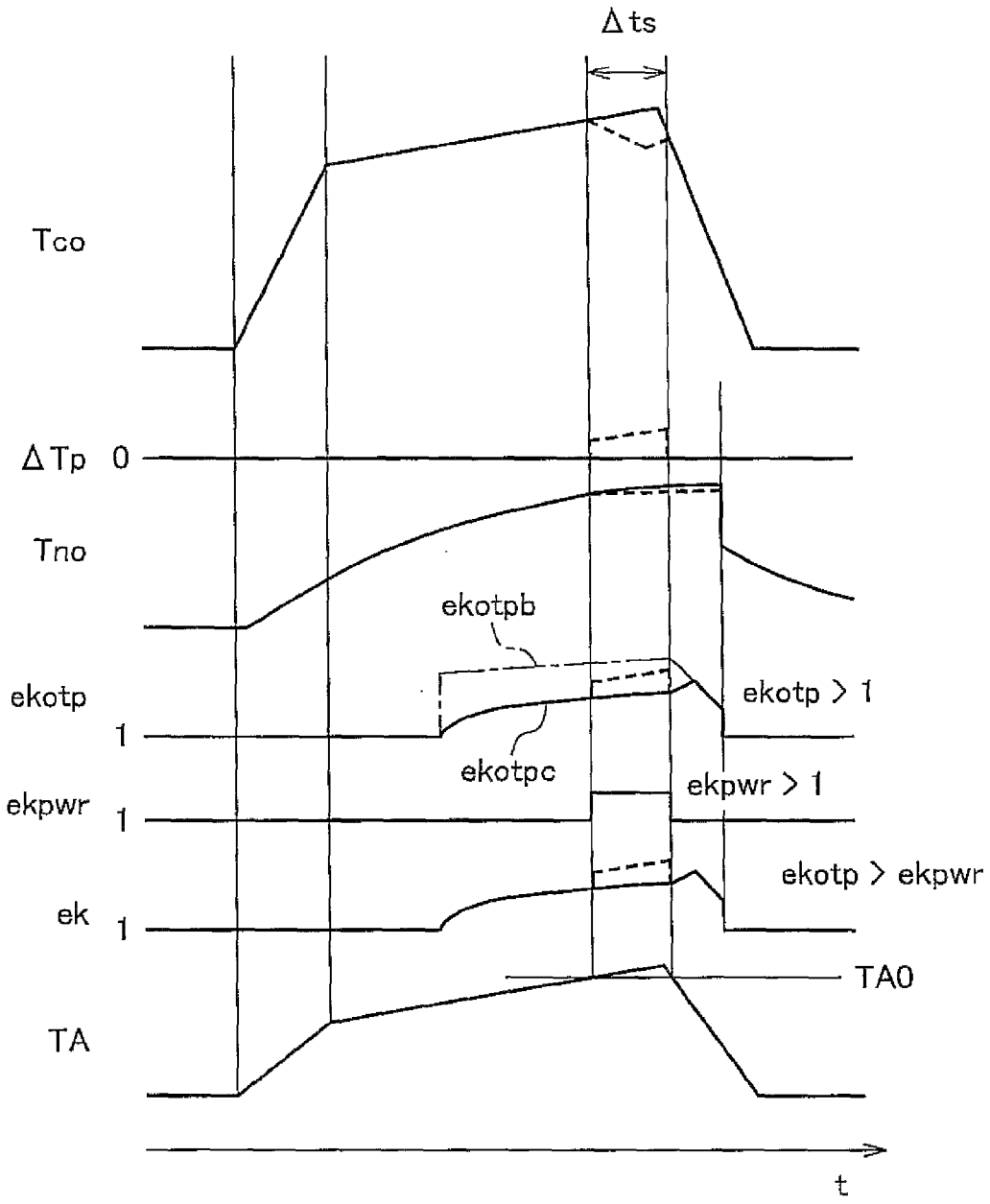
FIG. 5 is a time chart that shows changes in a convergence temperature Tco, a temperature correction amount for power boosting ΔTp, an ordinary temperature Tno, an OTP boost value ekotp, a power boost value ekpwr, a boost reflected value ek, and an opening degree TA of a throttle valve, according to Embodiment 1.

FIG. 5 is a time chart that shows changes in the convergence temperature Tco, the temperature correction amount for power boosting ΔTp, the ordinary temperature Tno, the OTP boost value ekotp, the power boost value ekpwr, the boost reflected value (final boost value) ek, and the opening degree TA of the throttle valve 13, according to this embodiment. The symbol TA0 in FIG. 5 denotes the opening degree of the throttle valve 13 as a threshold value where it is determined whether the power boosting is performed. That is, when the opening degree TA of the throttle valve 13 is greater than or equal to TA0, it is determined that the operating condition of the internal combustion engine 1 is in the second specified operating condition.

In FIG. 5, the period in which the OTP boost value ekotp>1 is the period in which the operating condition of the internal combustion engine 1 is in the first specified operating condition, and the period in which the power boost value ekpwr>1 is the period in which the operating condition of the internal combustion engine 1 is in the second specified operating condition. That is, in the period Δts, the operating condition of the internal combustion engine 1 is in the first specified operating condition as well as in the second specified operating condition. Furthermore, in the period Δts, because the OTP boost reference value ekotpb is greater than the OTP boost correction value ekotpc, the OTP boost correction value ekotpc is selected as the OTP boost value ekotp (that is, OTP boost value ekotp=OTP boost correction value ekotpc).

In the period Δts, because the OTP boost value ekotp is greater than the power boost value ekpwr, the OTP boosting is selected and performed as the boost correction (that is, boost reflected value ek=OTP boost value ekotp).

At this time, in the period Δts, when the temperature correction amount for power boosting ΔTp is calculated in accordance with the power boost value ekpwr, the value as shown with a dashed line in FIG. 5 is obtained. Furthermore, when the convergence temperature Tco and the ordinary temperature Tno are calculated by reflecting the temperature correction amount for power boosting ΔTp, respective values are obtained as shown with the dashed lines in FIG. 5. When the convergence temperature Tco is calculated as a low value as shown with the dashed line, the OTP boost correction value ekotpc that is calculated by using the calculated value of the convergence temperature Tco becomes large as shown with the dashed line in FIG. 5. As a result, the boost reflected value ek becomes unnecessarily large as shown with the dashed line in FIG. 5.

However, in this embodiment as described above, during the period Δts where ekotp>1 and ekpwr>1, the convergence temperature Tco is calculated on the assumption that the temperature correction amount for power boosting ΔTp is zero as shown with a solid line in FIG. 5. Accordingly, the convergence temperature Tco becomes the value that is shown with the solid line in FIG. 5. That is, the convergence temperature Tco is prevented from being calculated as the temperature lower than the actual convergence temperature. Therefore, as shown with the solid line in FIG. 5, the OTP boost correction value ekotpc is prevented from becoming large. As a result, the boost reflected value ek is prevented from becoming unnecessarily large.

[OTP Boost Value Calculation Flow]

Figure 6:
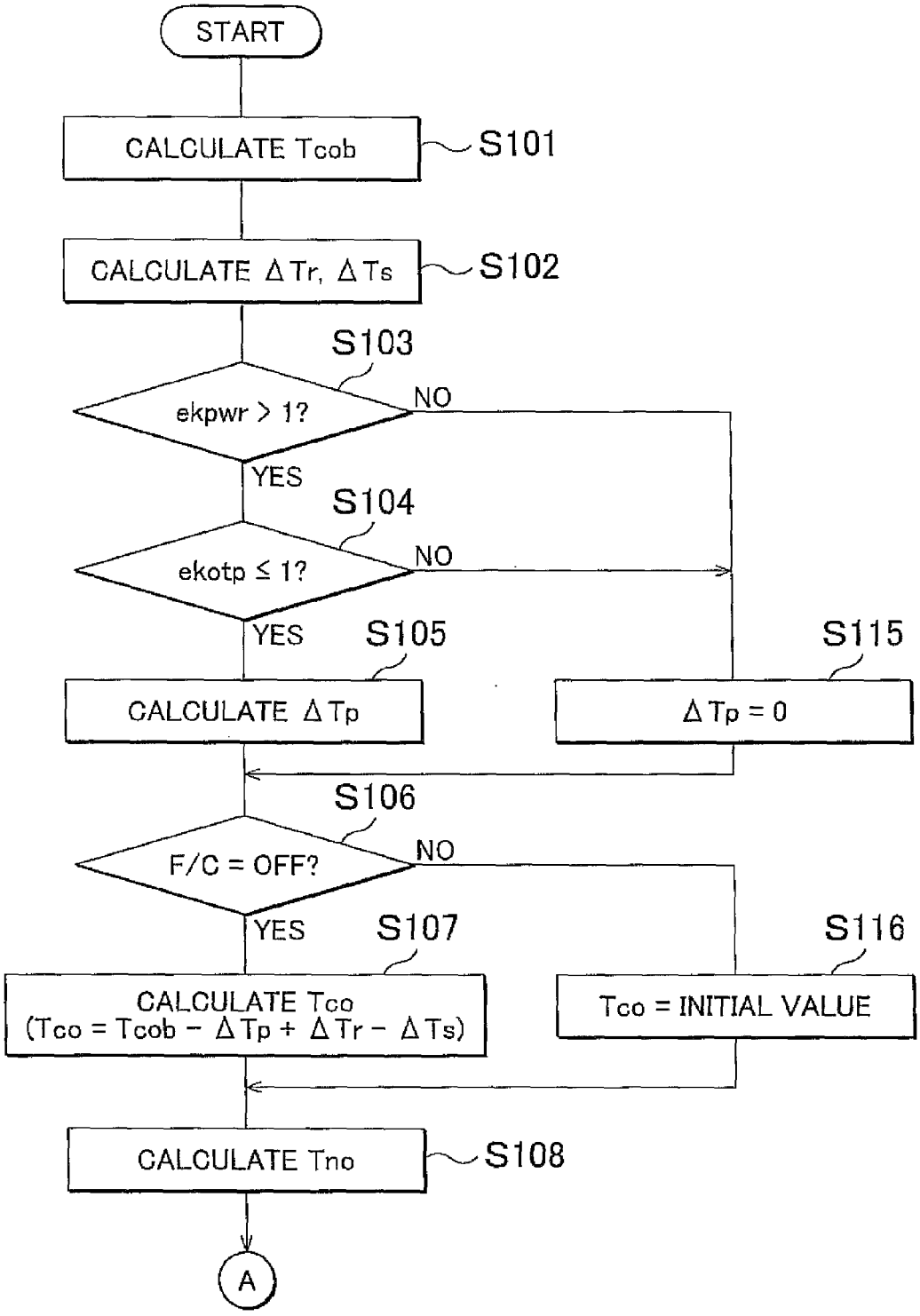
FIG. 6 is a part of a flowchart that shows a calculation flow of the OTP boost value according to Embodiment 1.
Figure 7:
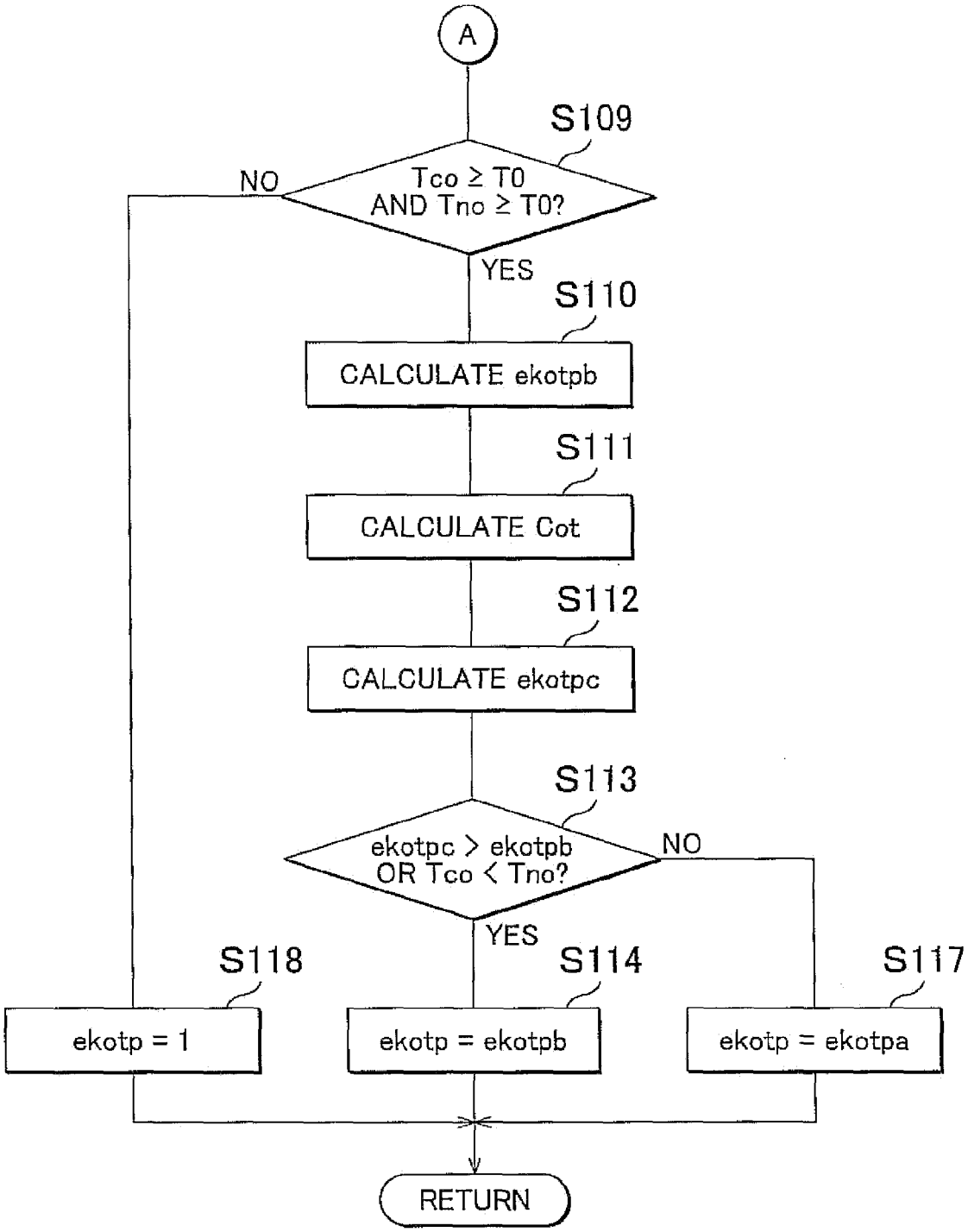
FIG. 7 is a part of a flowchart that shows a calculation flow of the OTP boost value according to Embodiment 1.

FIGS. 6 and 7 are flowcharts that show the calculation flow of the OTP boost value according to this embodiment. In this embodiment, the ECU 20 repeatedly performs this flow at specified intervals.

In a step S101 of this flow, the reference convergence temperature calculation section 2031 calculates the reference convergence temperature Tcob. Next, in a step S102, the temperature correction amount for retardation calculation section 2032 calculates the temperature correction amount for retardation ΔTr, and the temperature correction amount for vehicle speed calculation section 2033 calculates the temperature correction amount for vehicle speed ΔTs.

Next, in a step S103, the ECU 20 determines whether the current power boost value ekpwr (the value that is calculated by the power boost value calculation section 206) is greater than 1 or not. In the step S103, if an affirmative determination is made, processing of a step S104 is performed next, and if a negative determination is made, processing of a step S115 is performed next.

In the step S104, the ECU 20 determines whether the current OTP boost value ekotp (the value that is calculated through previous execution of this flow) is equal to or lower than 1 or not. In the step S104, if an affirmative determination is made, processing of a step S105 is performed next, and if a negative determination is made, processing of a step S115 is performed next.

In the step S105, the temperature correction amount for power boosting calculation section 2034 calculates the temperature correction amount for power boosting ΔTp. On the other hand, in the step S115, the ECU 20 sets the temperature correction amount for power boosting ΔTp to zero.

Next, in a step S106, the ECU 20 determines whether a fuel cut control (F/C) in the internal combustion engine 1 is turned OFF. In the step S106, if an affirmative determination is made, processing of a step S107 is performed next, and if a negative determination is made, processing of a step S116 is performed next.

In the step S107, the convergence temperature calculation section 2035 calculates the convergence temperature Tco by using the above equation (3). On the other hand, in the step S116, the ECU 20 sets the convergence temperature Tco to a predetermined initial value.

Next, in a step S108, the ordinary temperature calculation section 2036 calculates the ordinary temperature Tno by using the above equation (4).

Next, in a step 109, it is determined whether the convergence temperature Tco is greater than or equal to the OT determination temperature T0 and the ordinary temperature Tno is greater than or equal to the OT determination temperature T0. In the step S109, if a negative determination is made, it can be determined that the operating condition of the internal combustion engine 1 is not in the first specified operating condition. In this case, in a next step S118, the ECU 20 sets the OTP boost value ekotp to 1. On the other hand, in the step S109, if an affirmative determination is made, it can be determined that the operating condition of the internal combustion engine 1 is in the first specified operating condition. In this case, in a next step S110, the OTP boost reference value calculation section 2051 calculates the OTP boost reference value ekotpb.

Next, in a step S111, the OTP boost correction factor calculation section 2052 calculates the OTP boost correction factor Cot by using the above equation (1). Next, in a step S112, the OTP boost correction value calculation section 2053 calculates the OTP boost correction value ekotpc by using the above equation (2).

Next, in a step S113, the OTP boost value determination section 2054 determines whether the OTP boost correction value ekotpc is greater than the OTP boost reference value ekotpb or the convergence temperature Tco is lower than the ordinary temperature Tno. In the step S113, if an affirmative determination is made, then, in a next step S114, the OTP boost value determination section 2054 selects the OTP boost reference value ekotpb as the OTP boost value ekotp. On the other hand, in the step S113, if a negative determination is made, then, in a next step S117, the OTP boost value determination section 2054 selects the OTP boost correction value ekotpc as the OTP boost value ekotp.

Embodiment 2

[Fuel Injection Control]

Schematic structure of the intake and the exhaust systems for the internal combustion engine according to this embodiment is the same as Embodiment 1. Hereinafter, the fuel injection control according to this embodiment will be described mainly about the points different from Embodiment 1.

Figure 8:
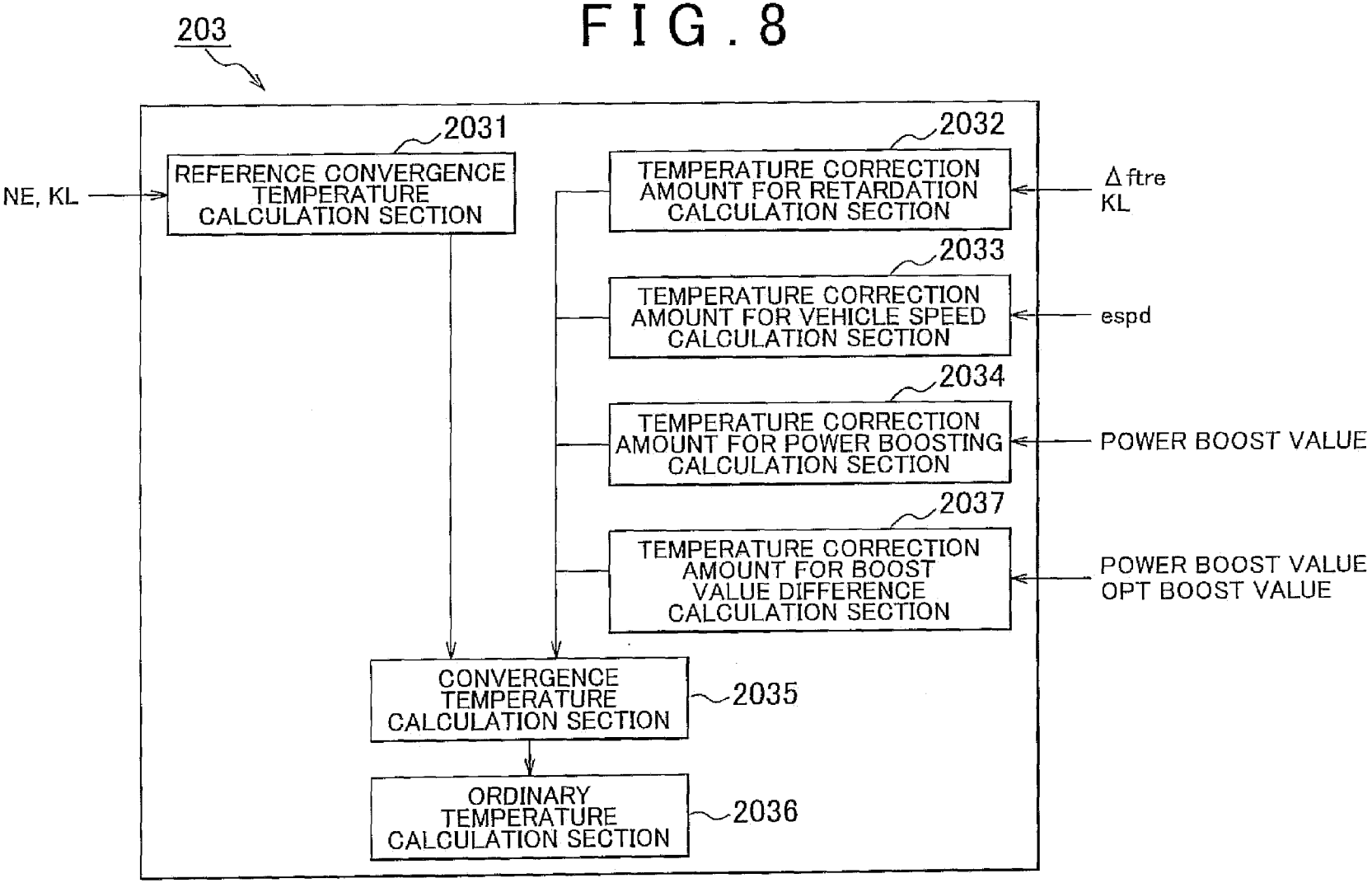
FIG. 8 is a block diagram that shows an outline of functional components of a temperature estimation section according to Embodiment 2.

FIG. 8 is a block diagram that shows an outline of functional components of the temperature estimation section 203 according to this embodiment. The temperature estimation section 203 according to this embodiment includes a reference convergence temperature calculation section 2031, a temperature correction amount for retardation calculation section 2032, a temperature correction amount for vehicle speed calculation section 2033, a temperature correction amount for power boosting calculation section 2034, a convergence temperature calculation section 2035, an ordinary temperature calculation section 2036, and in addition a temperature correction amount for boost value difference calculation section 2037. The functional components of a part relating to the fuel injection control in the ECU 20 other than those described above are the same as those in Embodiment 1.

The temperature correction amount for boost value difference calculation section 2037 calculates a temperature correction amount for boost value difference in accordance with the value that is obtained by a subtraction of the OTP boost value calculated with the OTP boost value calculation section 205 from the power boost value calculated with the power boost value calculation section 206. The temperature correction amount for boost value difference is a temperature decrement quantity of the exhaust gas catalytic converter 17 which is caused by an increase in the fuel injection amount equivalent to the difference between the power boost value and the OTP boost value. The ECU 20 stores in advance a map or a function that shows a relation between a boost value difference that is the value obtained by the subtraction of the OTP boost value from the power boost value and the temperature correction amount for boost value difference. The temperature correction amount for boost value difference calculation section 2037 calculates the temperature correction amount for boost value difference by using the map or the function.

Here, in this embodiment, as in the case of Embodiment 1, when both the OTP boost value and the power boost value are greater than 1 (that is, the operating condition of the internal combustion engine 1 is in the first specified operating condition as well as in the second specified operating condition), the greater value of the OTP boost value and the power boost value is determined to be the boost value, and the boost correction of the fuel injection amount is performed. Therefore, when the power boost value is greater than the OTP boost value, the power boosting is performed.

At this time, in this embodiment, the convergence temperature calculation section 2035 calculates the convergence temperature of the exhaust gas catalytic converter 17 in accordance with the temperature correction amount for boost value difference in place of the temperature correction amount for power boosting. That is, in this case, the convergence temperature Tco is calculated by using the following equation (5) in accordance with the reference convergence temperature Tcob, the temperature correction amount for retardation ΔTr, the temperature correction amount for vehicle speed ΔTs, and the temperature correction amount for boost value difference ΔTpo.

$$Tco=Tcob-\Delta Tpo+\Delta Tr-\Delta Ts \quad (5)$$

In this case also, the correction items that correct the reference convergence temperature are not limited to the temperature correction amount for retardation and the temperature correction amount for vehicle speed as long as at least the temperature correction amount for boost value difference is included.

The ordinary temperature calculation section 2036 calculates the ordinary temperature Tno by smoothing, with the above equation (4), the convergence temperature Tco that is calculated by using the above equation (5). In addition, the OTP boost correction factor calculation section 2052 in the OTP boost value calculation section 205 calculates the OTP boost correction factor Cot by using the above equation (1) in accordance with the convergence temperature Tco and the ordinary temperature Tno that are calculated as described above and the OT determination temperature T0. The OTP boost correction value calculation section 2053 calculates the OTP boost correction value ekotpc by using the above equation (2).

Figure 9:
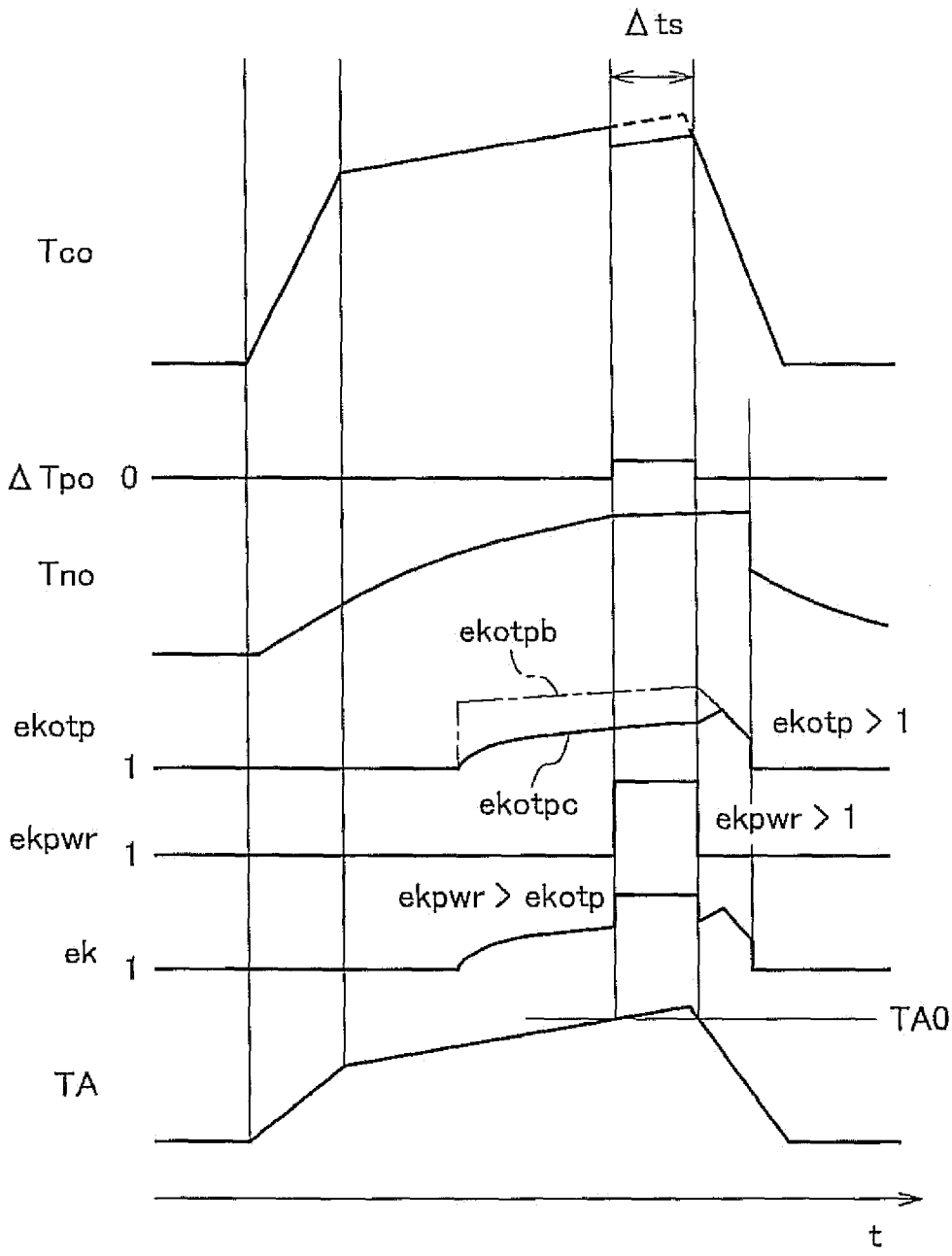
FIG. 9 is a time chart that shows changes in a convergence temperature Tco, a temperature correction amount for power boosting ΔTpo, an ordinary temperature Tno, an OTP boost value ekotp, a power boost value ekpwr, a boost reflected value ek, and an opening degree TA of a throttle valve, according to Embodiment 2.

FIG. 9 is, a time chart that shows changes in the convergence temperature Tco, the temperature correction amount for boost value difference ΔTpo, the ordinary temperature Tno, the OTP boost value ekotp, the power boost value ekpwr, the boost reflected value ek, and the opening degree TA of the throttle valve 13, according to this embodiment. The symbol TA0 in FIG. 9 denotes, as in the case of FIG. 5, the opening degree of the throttle valve 13 as a threshold value of whether the power boosting is performed.

In the period Δts in FIG. 9, because the power boost value ekpwr is greater than the OTP boost value ekotp, the power boosting is selected and performed as the boost correction (that is, boost reflected value ek=power boost value ekpwr). At this time, in this embodiment, the temperature correction amount for boost value difference ΔTpo is calculated, and the convergence temperature Tco is calculated with the effect of the temperature correction amount for boost value difference ΔTpo. Therefore, the convergence temperature Tco becomes lower than the case of Embodiment 1 where it is calculated in accordance with the above equation (3) on the assumption that the temperature correction amount for power boosting ΔTp=0 (the value shown with the dashed line in FIG. 9). The ordinary temperature Tno is calculated in accordance with the convergence temperature Tco that is calculated as described above.

According to this embodiment, the convergence temperature and the ordinary temperature, which are calculated during the power boosting, are calculated as the values that reflect the temperature decrement quantity which is caused by the increase in the fuel injection amount equivalent to the difference between the power boost value and the OTP boost value. Therefore, the OTP boost correction value that is calculated by using the convergence temperature and the ordinary temperature can be determined to be more appropriate value. As a result, when the OTP boosting is performed by using the OTP boost correction value as the OTP boost value for the next time, more appropriate boost correction of the fuel injection amount can be performed.

[OTP Boost Value Calculation Flow]

Figure 10:
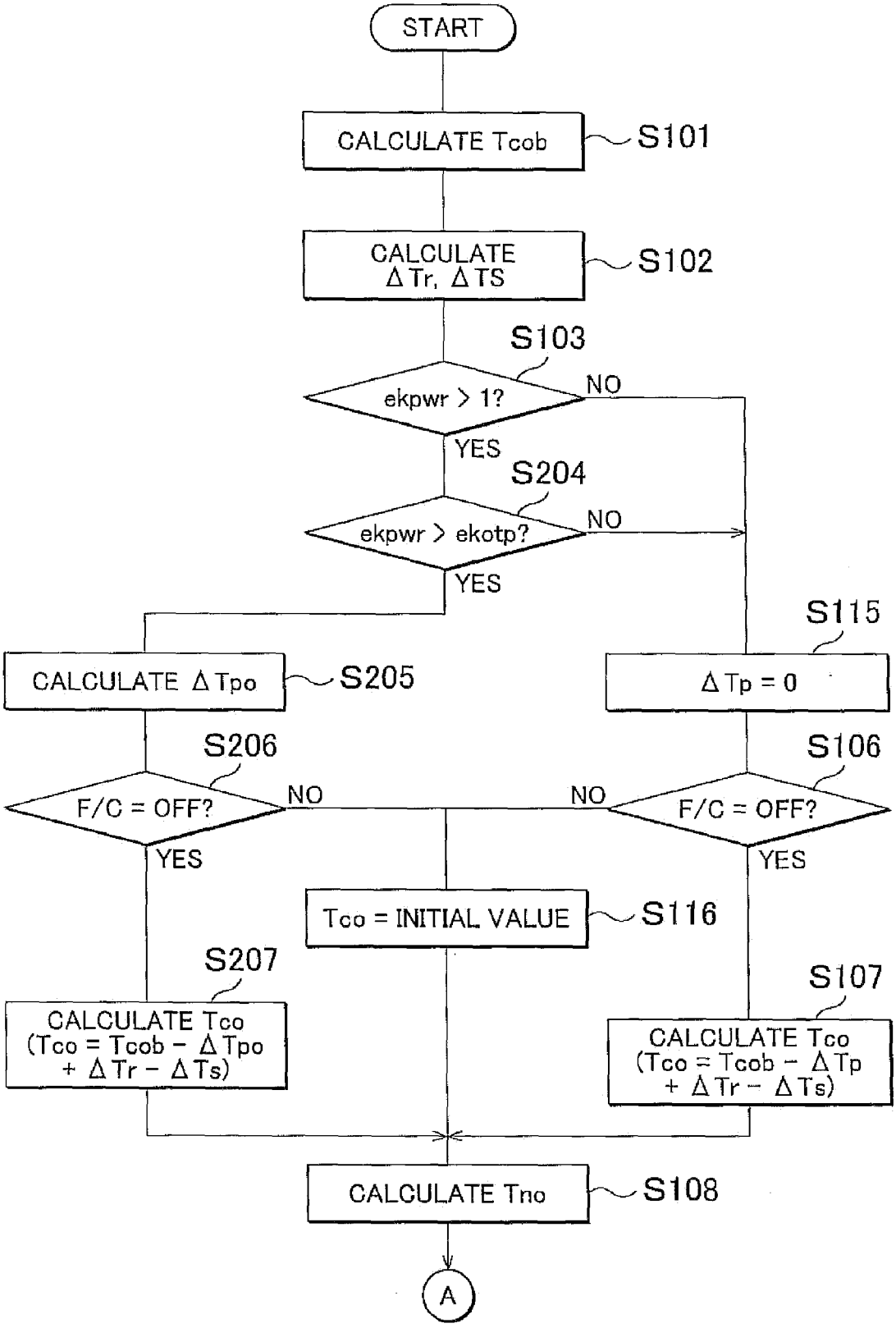
FIG. 10 is a part of a flowchart that shows a calculation flow of the OTP boost value according to Embodiment 2.
Figure 4:
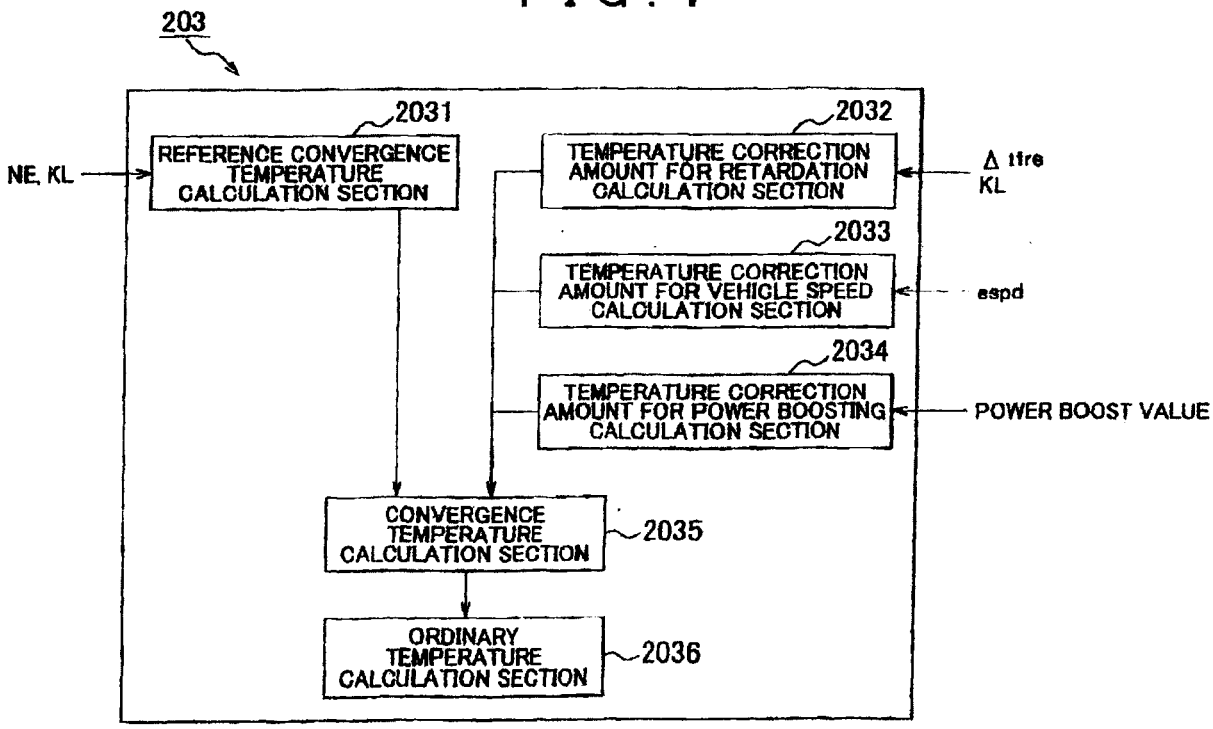
Figure 7:
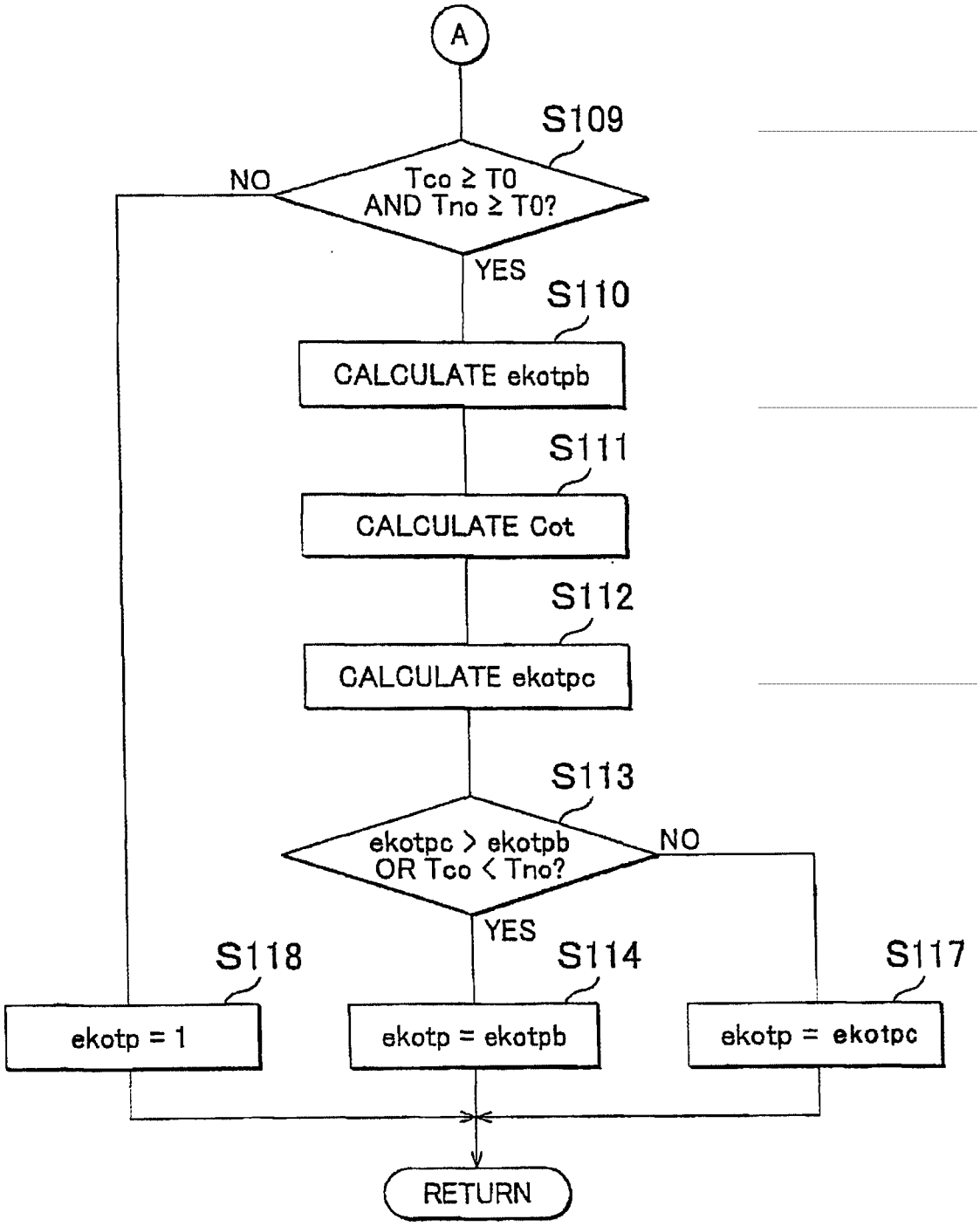
Figure 8:
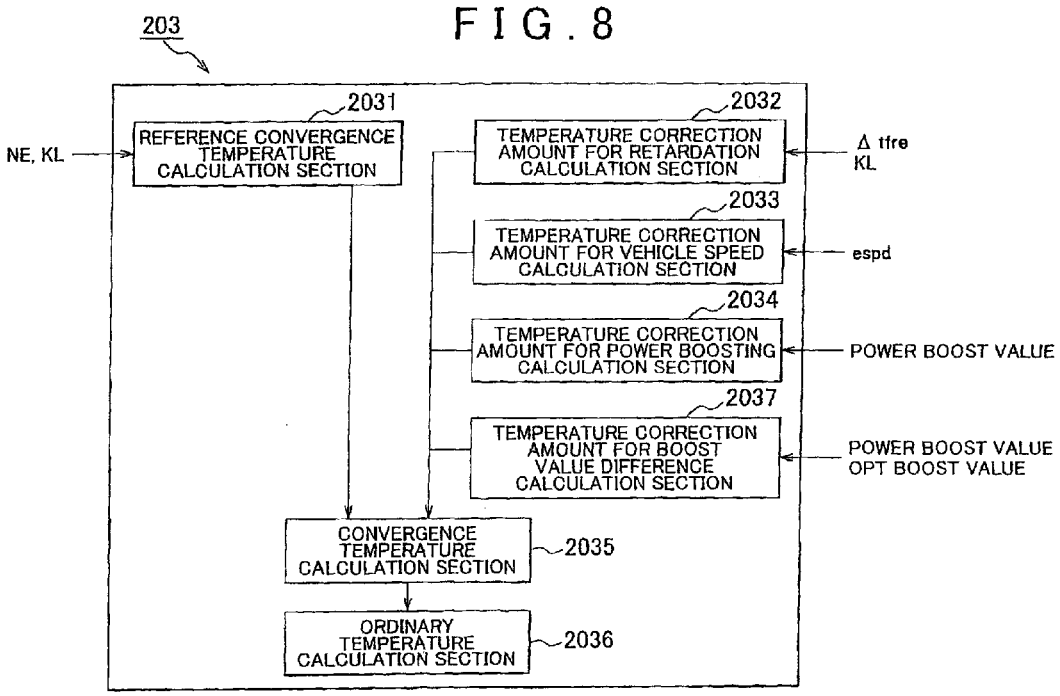

FIG. 10 is a part of a flowchart that shows a calculation flow of the OTP boost value according to this embodiment. In this embodiment, the ECU 20 repeatedly performs this flow at specified intervals. Here, steps that perform the same processing as steps in the flowchart shown in FIG. 6 are given with the same reference numerals and symbols, and the descriptions are not repeated. In addition, subsequent flow to the step S108 is the same as that in the flowchart shown in FIG. 7. In this embodiment, the ECU 20 repeatedly performs this flow at specified intervals.

In this flow, if an affirmative determination is made in the step S103, the processing of a step S204 is performed next. In the step S204, the ECU 20 determines whether the current power boost value ekpwr (the value that is calculated by the power boost value calculation section 206) is greater than the current OTP boost value ekotp (the value that is calculated through previous execution of this flow). In the step S204, if an affirmative determination is made, processing of a step S205 is performed next, and if a negative determination is made, processing of a step S115 is performed next.

In the step S205, the temperature correction amount for boost value difference calculation section 2037 calculates the temperature correction amount for boost value difference ΔTpo. Next, in a step S206, the ECU 20 determines whether the fuel cut control (F/C) in the internal combustion engine 1 is turned OFF. In the step S206, if an affirmative determination is made, processing of a step S207 is performed next, and if a negative determination is made, processing of a step S116 is performed next.

In the step S207, the convergence temperature calculation section 2035 calculates the convergence temperature Tco by using the above equation (5). Next, processing of the step S108 is performed next.

According to this flow, when the power boost value ekpwr is greater than the OTP boost value ekotp, in a step S207, the convergence temperature that reflects the temperature correction amount for boost value difference ΔTpo is calculated. On the other hand, when the power boost value ekpwr is smaller than or equal to the OTP boost value ekotp, as in the case of Embodiment 1, in the step S107, the convergence temperature is calculated on the assumption that the temperature correction amount for power boosting ΔTp is zero.

The invention claimed is:

1. A fuel injection control apparatus for an internal combustion engine, comprising:

a fuel injection amount control section that increases a fuel injection amount by a larger one of an OTP boost value of an OTP boosting and a power boost value of a power boosting when both of an OTP boosting execution condition and a power boosting execution condition are met, in which the OTP boosting execution condition is an execution condition for the OTP boosting that increases the fuel injection amount in order to prevent overheating of an exhaust gas catalytic converter, and the power boosting execution condition is an execution condition for the power boosting that increases the fuel injection amount in order to set air-fuel ratio of mixture to output air-fuel ratio;

a convergence temperature estimation section that estimates a convergence temperature of the exhaust gas catalytic converter on the assumption that an operating condition of the internal combustion engine is in a normal operating condition by correcting a reference convergence temperature, which is calculated in accordance with engine speed and engine load, based on a temperature decrement quantity of the exhaust gas catalytic converter which is caused by at least the power boosting;

an ordinary temperature estimation section that estimates an ordinary temperature that is a current temperature of the exhaust gas catalytic converter on the assumption that an operating condition of the internal combustion engine is in a normal operating condition, in accordance with the convergence temperature;

an OTP boost correction value calculation section that calculates an OTP boost correction value, which is the OTP boost value on the assumption that temperature of the exhaust gas catalytic converter is the ordinary temperature, by correcting an OTP boost reference value, which is the OTP boost value on the assumption that the temperature of the exhaust gas catalytic converter is the convergence temperature, in accordance with the ordinary temperature and the convergence temperature; and an OTP boost value determination section that selects either of the OTP boost reference value or the OTP boost correction value as the OTP boost value when the OTP boosting is performed, wherein when both of the OTP boosting execution condition and the power boosting execution condition are met, the convergence temperature estimation section estimates the convergence temperature on the assumption that the temperature decrement quantity of the exhaust gas catalytic converter which is caused by the power boosting is zero.

2. The fuel injection control apparatus according to claim 1, further comprising:

a temperature decrement quantity calculation section that calculates the temperature decrement quantity of the exhaust gas catalytic converter which is caused by the increase in the fuel injection amount equivalent to difference between the power boost value and the OTP boost value when both of the OTP boosting execution condition and the power boosting execution condition are met and when the power boost value is greater than the OTP boost value, wherein when both of the OTP boosting execution condition and the power boosting execution condition are met and when the power boost value is greater than the OTP boost value, the convergence temperature estimation section estimates the convergence temperature by correcting the reference convergence temperature based on the temperature decrement quantity that is calculated by the temperature decrement quantity calculation section in place of the temperature decrement quantity of the exhaust gas catalytic converter which is caused by the power boosting.

3. The fuel injection control apparatus according to claim 1, wherein:

when the convergence temperature is lower than the ordinary temperature, or when the OTP boost reference value is smaller than the OTP boost correction value, the OTP boost value determination section determines to set the OTP boost reference value as the OTP boost value; and in the case that the ordinary temperature is lower than or equal to the convergence temperature and that the OTP boost correction value is smaller than or equal to the OTP boost reference value, the OTP boost value determination section determines to set the OTP boost correction value as the OTP boost value.

4. A fuel injection control method for an internal combustion engine, comprising:

increasing a fuel injection amount by a larger one of an OTP boost value of an OTP boosting and a power boost value of a power boosting when both of an OTP boosting execution condition and a power boosting execution condition are met, in which the OTP boosting execution condition is an execution condition for the OTP boosting that increases the fuel injection amount in order to prevent overheating of an exhaust gas catalytic converter, and the power boosting execution condition is an execution condition for the power boosting that increases the fuel injection amount in order to set air-fuel ratio of mixture to output air-fuel ratio;

estimating a convergence temperature of the exhaust gas catalytic converter on the assumption that an operating condition of the internal combustion engine is in a normal operating condition by correcting a reference convergence temperature, which is calculated in accordance with engine speed and engine load, based on a temperature decrement quantity of the exhaust gas catalytic converter which is caused by at least the power boosting;

estimating an ordinary temperature that is a current temperature of the exhaust gas catalytic converter on the assumption that an operating condition of the internal combustion engine is in a normal operating condition, in accordance with the convergence temperature;

calculating an OTP boost correction value, which is the OTP boost value on the assumption that temperature of the exhaust gas catalytic converter is the ordinary temperature, by correcting an OTP boost reference value, which is the OTP boost value on the assumption that the temperature of the exhaust gas catalytic converter is the convergence temperature, in accordance with the ordinary temperature and the convergence temperature; and selecting either of the OTP boost reference value or the OTP boost correction value as the OTP boost value when the OTP boosting is performed, wherein when both of the OTP boosting execution condition and the power boosting execution condition are met, the convergence temperature is estimated on the assumption that the temperature decrement quantity of the exhaust gas catalytic converter which is caused by the power boosting is zero.

5. The fuel injection control apparatus according to claim 2, wherein:

when the convergence temperature is lower than the ordinary temperature, or when the OTP boost reference value is smaller than the OTP boost correction value, the OTP boost value determination section determines to set the OTP boost reference value as the OTP boost value; and in the case that the ordinary temperature is lower than or equal to the convergence temperature and that the OTP boost correction value is smaller than or equal to the OTP boost reference value, the OTP boost value determination section determines to set the OTP boost correction value as the OTP boost value.

* * * * *

UNITED STATES PATENT AND TRADEMARK OFFICE

CERTIFICATE OF CORRECTION

PATENT NO. : 8,798,893 B2
APPLICATION NO. : 13/368647
DATED : August 5, 2014
INVENTOR(S) : Masahiro Kachi et al.

It is certified that error appears in the above-identified patent and that said Letters Patent is hereby corrected as shown below:

Title page should be deleted and substitute therefor the attached Title page.

In the Drawings:

Delete Figures 4, 7, and 8, Insert Replacement Sheets for Figures 4, 7, and 8.

Signed and Sealed this
Twenty-fifth Day of August, 2015

Michelle K. Lee

Michelle K. Lee
*Director of the United States Patent and Trademark Office*

(12) United States Patent
Kachi et al.

(10) Patent No.: US 8,798,893 B2
(45) Date of Patent: Aug. 5, 2014

(54) FUEL INJECTION CONTROL APPARATUS FOR INTERNAL COMBUSTION ENGINE AND FUEL INJECTION CONTROL METHOD FOR INTERNAL COMBUSTION ENGINE

(75) Inventors: Masahiro Kachi, Susono (JP); Yasuyuki Takama, Gotemba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 299 days.

(21) Appl. No.: 13/368,647

(22) Filed: Feb. 8, 2012

(65) Prior Publication Data

US 2012/0203445 A1 Aug. 9, 2012

(30) Foreign Application Priority Data

Feb. 8, 2011 (JP) ..... 2011-025103

(51) Int. Cl.
*F02D 41/10* (2006.01)

(52) U.S. Cl.
USPC ..... 701/104; 123/676; 123/492; 123/682

(58) Field of Classification Search
CPC ..... F02D 41/1446; F02D 41/1447
USPC ..... 701/104; 123/492, 676, 682, 689
See application file for complete search history.

(56) References Cited

U.S. PATENT DOCUMENTS

| | | | | |
|---|---|---|---|---|
| 5,239,965 | A * | 8/1993 | Ninomiya | 123/492 |
| 6,578,557 | B1 * | 6/2003 | Messick | 123/491 |
| 7,228,221 | B2 * | 6/2007 | Niimi | 701/104 |
| 7,438,048 | B2 * | 10/2008 | Onobayashi et al. | 123/352 |
| 7,934,371 | B2 * | 5/2011 | Sugimoto | 60/285 |
| 8,447,500 | B2 * | 5/2013 | Suzuki et al | 701/105 |
| 8,560,209 | B2 * | 10/2013 | Stefanon | 701/104 |
| 2011/0251779 | A1 | 10/2011 | Kachi et al. | |

FOREIGN PATENT DOCUMENTS

| | | | |
|---|---|---|---|
| JP | 2003343242 | A | 12/2003 |
| JP | 2011-220214 | A | 11/2011 |

* cited by examiner

*Primary Examiner* — Erick Solis
(74) *Attorney, Agent, or Firm* — Gifford, Krass, Sprinkle, Anderson & Citkowski, P.C.

(57) ABSTRACT

A fuel injection control for an internal combustion engine includes: estimating a convergence temperature of the exhaust gas catalytic converter; calculating an OTP boost value using the estimated convergence temperature: and estimating the convergence temperature on the assumption that the temperature decrement quantity of the exhaust gas catalytic converter which is caused by the power boosting is zero when both of the OTP boosting execution condition and the power boosting execution condition are met.

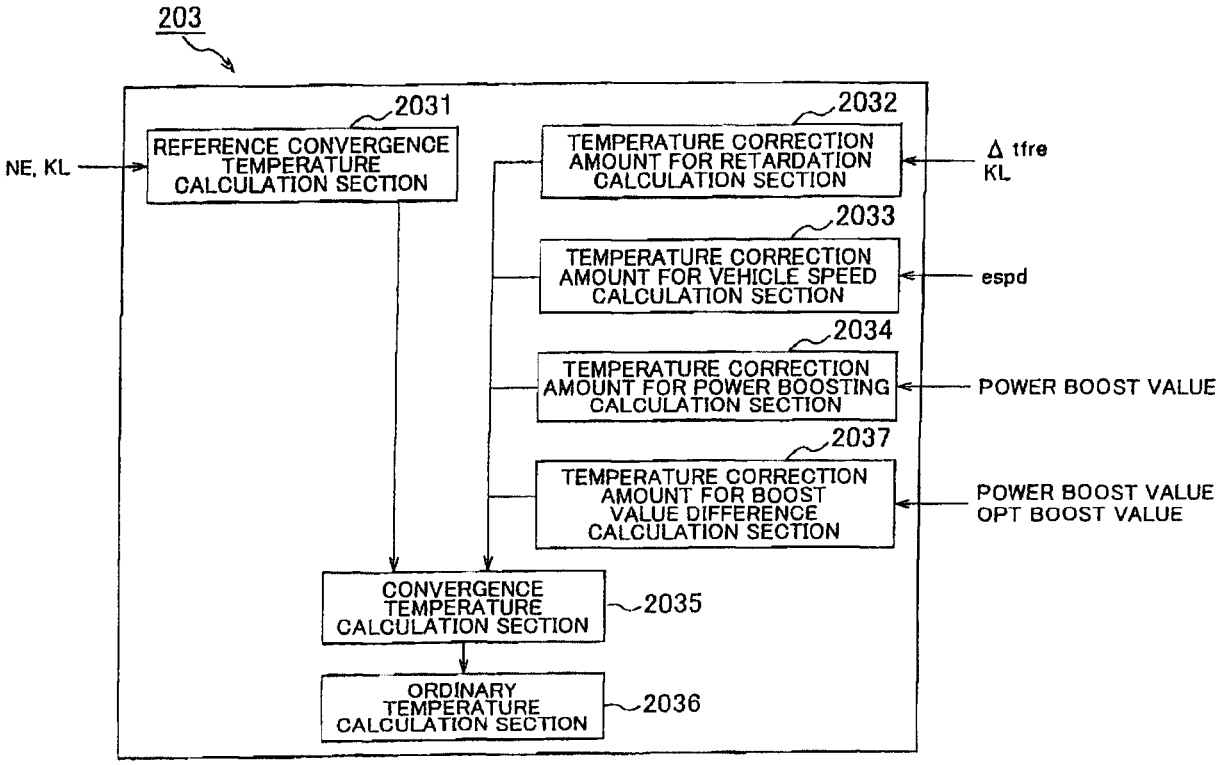

5 Claims, 10 Drawing Sheets